US005390834A

United States Patent [19]

Bitter et al.

[11] Patent Number: 5,390,834

[45] Date of Patent: Feb. 21, 1995

[54] TROLLEY DESIGNED FOR USE AS A CONVEYING TROLLEY FOR CONVEYING PRODUCTS, IN PARTICULAR FOODS AND DRINKS FOR SALE

[75] Inventors: Jacobus M. Bitter, Naaldwijk; Camille W. van den Brande, Haarlem; Reinardus L. M. Hazelebach, Capelle aan den IJssel; Niklaas E. van Hylckama Vlieg, Delft; Andries Rijfers, Alphen aan den Rijn; Johannes J. Smits, Hoek van Holland; Theodorus J. H. v. Steenbergen, Bergschenhoek; Jacco M. Van Stenis, Ridderkerk, all of Netherlands

[73] Assignee: Compagnie Internationale des Wagons-Lits et du Tourisme, S.A., Brussels, Belgium

[21] Appl. No.: 39,462

[22] PCT Filed: Oct. 23, 1991

[86] PCT No.: PCT/NL91/00210

§ 371 Date: Jun. 23, 1993

§ 102(e) Date: Jun. 23, 1993

[87] PCT Pub. No.: WO92/06617

PCT Pub. Date: Apr. 30, 1992

[30] Foreign Application Priority Data

Oct. 23, 1990 [NL] Netherlands ..... 9002312

[51] Int. Cl.[6] ..... A47B 31/02

[52] U.S. Cl. ..... 222/608; 222/113; 222/129.1; 222/146.1

[58] Field of Search ..... 222/54, 129.1, 129.4, 222/145, 608, 146.1, 113, 23, 39

[56] References Cited

U.S. PATENT DOCUMENTS

| | | | |
|---|---|---|---|
| 2,076,881 | 4/1937 | Cunningham | 222/113 X |
| 3,240,395 | 3/1966 | Carver | 222/608 X |
| 4,076,349 | 2/1978 | Gettleman et al. . | |
| 4,161,234 | 7/1979 | Munn . | |
| 4,406,382 | 9/1983 | Roth | 222/23 X |
| 5,154,317 | 10/1992 | Roppolo, III | 222/608 X |

FOREIGN PATENT DOCUMENTS

| | | |
|---|---|---|
| 2424723 | 11/1979 | France . |
| 1554504 | 2/1971 | Germany . |
| 2508521 | 9/1976 | Germany . |
| 2140678 | 12/1984 | United Kingdom . |

*Primary Examiner*—Gregory L. Huson
*Attorney, Agent, or Firm*—Bell, Seltzer, Park & Gibson

[57] ABSTRACT

A trolley is described, which is designed for conveying products, in particular foods and drinks for sale, and which has plural containers which can be placed one above the other in a frame. The frame is provided with wheels and has a fixed water supply container with insulation and heating means and a battery-supplied pump for conveying the water heated in the supply container to one or more tap points. The plural containers are selected from: (i) an insulated, heat-conserving container with heating means; (ii) an insulated cooling container which may optionally have cooling means; (iii) an additional insulated hot container which may be coupled to the fixed water supply container and which may optionally be provided with heating means; and (iv) a supply container which can optionally be insulated. The heating means, cooling means and/or containers can be exchangeable for each other. A lifting device with scissor mechanism and belt drive for raising the trolley to a desired height is also described.

9 Claims, 4 Drawing Sheets

TROLLEY DESIGNED FOR USE AS A CONVEYING TROLLEY FOR CONVEYING PRODUCTS, IN PARTICULAR FOODS AND DRINKS FOR SALE

BACKGROUND OF THE INVENTION

The invention relates to a trolley designed for use as a conveying trolley for conveying products, in particular foods and drinks for sale, comprising a frame provided with wheels and carrying one or more containers.

Such a trolley is known from U.S. Pat. No. 4,076,349. Said trolley comprises a frame provided with castors, and having a rectangular unitary cabinet structure. On top of the cabinet a plurality of liquid dispensing units are mounted, accessible for service from both front and rear sides. Hot drinks are contained in containers on top of the trolley and are prepared in advance, whereas the cold drinks are fed from the inside of the trolley by means of $CO_2$-pressure. Further a fixed ice chamber is present. No provisions are made for containing and distributing hot foods. This known trolley has a number of disadvantages. In the first place, it is relatively unstable, as rather large quantities of hot beverages are present in containers on top of the trolley and no provisions are made for containing hot foods. The hot drinks are prepared in advance and carried in insulated containers, which means a limited distribution time. Coffee in particular relatively soon acquires an unpleasant taste. Finally, the number of the drinks which can be carried on such a known trolley is very limited, since the dimensions of the trolley cannot be great due to the requirements in use.

Said trolley is used for selling or distributing beverages at conventions, conferences, meetings and similar occasions. The purposes thereof is to be able to serve a large number of beverages in a very limited time. The object of the present invention is to eliminate the above-mentioned disadvantages and to provide a generally improved trolley for conveying products, in particular food and drinks for sale. To that end the invention is characterized in that the containers (A–D) are or can be placed one above the other in the frame, the frame in the bottom thereof having a fixed water supply container with insulation and heating means. A pump with battery supply is also present for conveying the water heated in said container to one or more tap points, and the containers (A–D) are selected from:

(i) an insulated heat-conserving container with heating means;

(ii) an insulated cooling container;

(iii) an additional insulated hot water container which is to be coupled to the fixed water supply container, and which may or may not be provided with heating means; and (iv) a supply container which may or may not be insulated.

The invention provides a trolley in which hot foods can be kept hot by using heating means and cold foods or drinks can be kept cold for a long time, and the hot drinks and liquid foods can in each case be prepared fresh from hot water and an extract. The trolley according to the invention is also extremely stable, in particular as the fixed water supply is situated in the bottom thereof. This water supply has generally already been brought to a temperature which is suitable for making coffee, tea, soup or the like. Since the drinks are prepared at the place of sale, excellent quality thereof can always be ensured.

The heating means are preferably exchangeable. This makes it possible to select whether or not to make a container carry out a heating function, with the result that the layout of the trolley or the function of the containers in use can be varied as desired.

The cooling container advantageously also comprises exchangeable cooling means which can be designed, for example, in the form of cooling elements to be placed in the cooling container or a cooling mechanism to be connected to the cooling container, supplied by, for example, a battery or a fossil fuel.

One or more of the containers are also advantageously exchangeable, which means that for replenishment thereof the particular containers in the trolley itself do not have to be cleaned and refilled. Instead, while the trolley is in a filling center, the containers can be removed from the trolley in their entirety, including their heating or cooling means, and filled containers can be placed therein. The layout of the trolley can also be varied as desired as regards the containers. For example, an additional hot water container, possibly having its own heating means, can be coupled to the water supply container and used if it is expected that a large quantity of hot drinks is going to be sold. This applies mutatis mutandis to the other containers.

The trolley according to the invention has the major advantage that it can operate autonomously for a longer period without the disadvantages described above occurring. The layout of the trolley can also be altered in many ways without too many complicated operations, all this being due to the exchangeability of the heating means, the cooling means and/or the containers themselves.

In a preferred embodiment of the invention, the heating and cooling means are interchangeable. In a further preferred embodiment, the heating means are in the form of a catalytic burner and the trolley is provided with one or more supply containers for a fossil fuel such as butane gas. In another preferred embodiment, at least one of the tap points is connected to supply means for adding an extract (such as coffee, tea, drinking chocolate, or soup, for example) to the water. A further preferred embodiment provides a temperature gauge and a return pipe near each tap point so that when a difference between a set and a measured temperature of the water exists, one or more valves in the return pipe are opened to return the water to the supply container until the set temperature has been reached. Gauges may ideally be provided in any of the embodiments for measuring the temperature and the level of the water in the supply container, monitoring whether or not the heating means are working, and measuring the charge condition of the battery supply of the pump. The gauges can be connected to a control unit which can deliver regulating or warning signals depending on the values measured by the gauges.

The invention also provides a lifting device, designed for raising, a trolley according to the invention to a desired height, the lifting device, at least comprising a scissor mechanism for moving a carrier face in the vertical direction, which is characterised in that the scissor mechanism comprises a belt drive. Said lifting device is particularly advantageous if the trolley is to be used in trains or other vehicles. The trolley can easily be raised to a desired height by means of the lifting device, without undue physical effort on the part of the user, following which the trolley can be wheeled off the lifting device into the train or other vehicle. As is known, platforms and trains are usually not at the same level. The lifting device can also be used to move the trolley from a high level to a low level, for example when it is being taken from the train.

The belt drive is preferably in the form of at least one belt, and in particular two belts which are connected by means of guide rollers to the bearing surface, and which are accommodated in columns fixed hingedly on either side of the lifting device. The belts can be moved by winding onto a common winding shaft, which winding shaft can be driven by a crank connected thereto.

BRIEF DESCRIPTION OF THE DRAWINGS

The invention will be explained in greater detail below with reference to the appended drawings, in which.

DETAILED DESCRIPTION OF THE DRAWINGS

Figure 1:
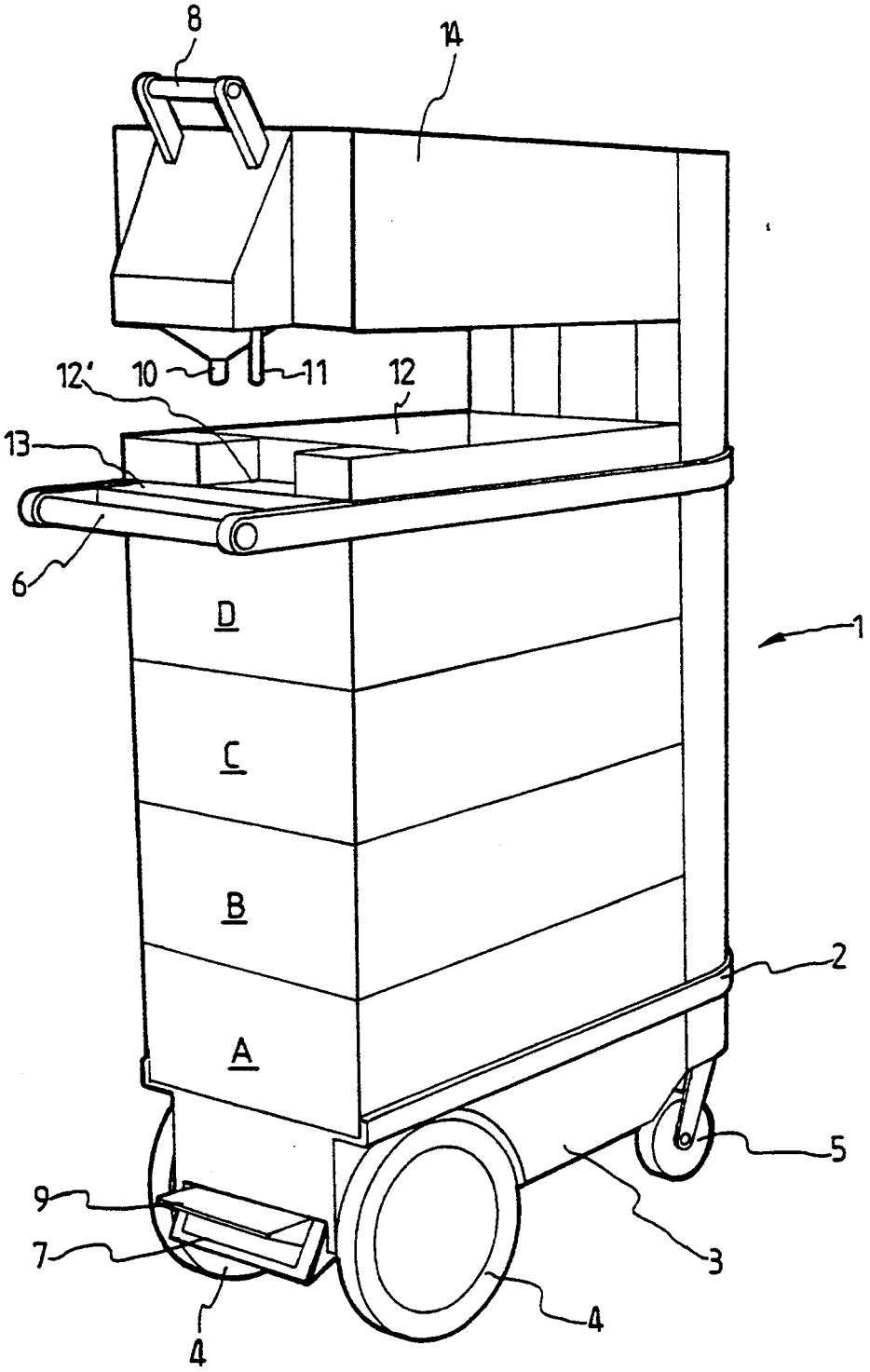
FIG. 1 shows a schematic perspective view of a trolley according to the invention.

In FIG. 1 the trolley according to the invention is indicated by 1 and comprises a frame 2 with a fixed water supply container 3. The frame 2 is provided with a set of fixed wheels 4 and a set of castors 5. The trolley can be moved by means of a handle 6. The user can tip the trolley backwards slightly by means of a bracket 7 (by placing a foot on it) and an additional handle 8, so that thresholds and the like can be passed. A brake control pedal is indicated by 9. A tap opening for coffee is shown at 10, and a tap opening for hot water at 11. Of course, the number of tap openings can be varied as desired.

A to D are various containers, exchangeable in this case, which can be stacked as desired, the heaviest container preferably being at the bottom, which improves the stability of the trolley. These containers can also be slid therein as drawers, depending on the design of the frame 2.

It will be clear that according to the invention the containers A to D can also be fixed in the frame and can be provided with heating means or cooling means as desired. For this fixing means can be present, for example in the form of an opening in the containers in which a closing cap, cooling means or heating means can be fixed as desired. This opening is advantageously situated on the rear side, i.e. the side of the trolley facing away from the user. The heating and/or cooling means can also be designed in such a way that they can be placed with the product in the container.

For example, if the trolley is to be used for the sale of foods and drinks on an early morning train, the container A can be a hot water container, since a large quantity of coffee, tea and the like is, of course, going to be sold. This hot water container A comprises coupling means (not shown) for coupling to the hot water supply container 3 and optionally its own heating means. The container B can be, for example, a cooling container for soft drinks and the like, and it may or may not be provided with its own cooling means. The containers C and D can be selected from a supply container or a heat-conserving container, the latter for keeping hot foods such as croissants, cheese rolls and the like hot. For the sake of simplicity, no closing devices (doors or the like) are shown, since it is not vitally important where these are situated. The closing devices will generally be situated at the side facing the user, i.e. at the side where the handle 6 is situated.

An open supply tray 12 is designed, for example, in such a way that empty cups and other small articles can be placed thereon. A money drawer is indicated by 13. Other supplies can be placed in a space 14.

Reference number 12' indicates the place where the cup or the like to be filled can be placed. It is, for example, designed in the form of a collection tray provided with a grille or the like to catch any spilt liquid.

Figure 2:
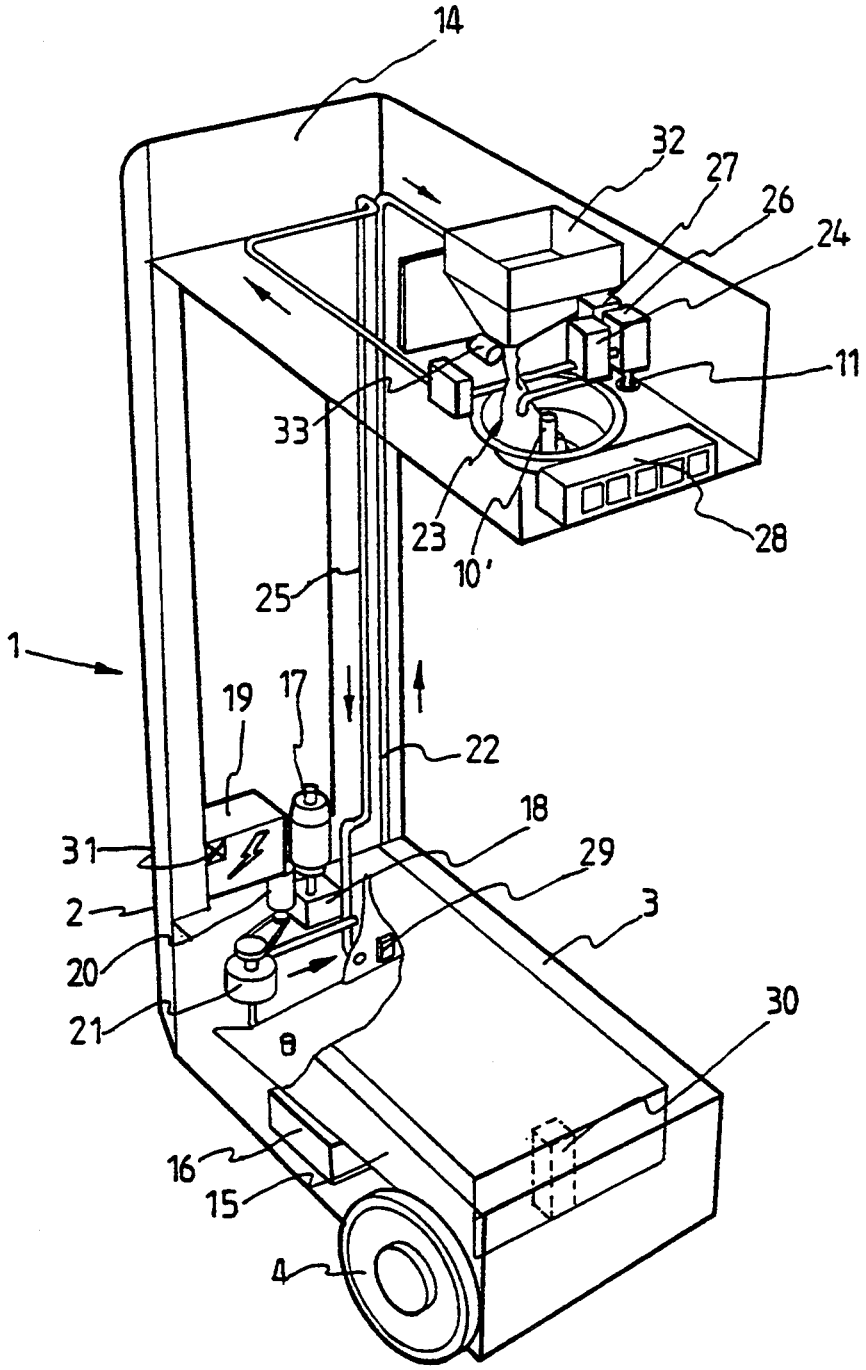
FIG. 2 shows a partially cut-away perspective view of the trolley according to FIG. 1.

The way in which the hot water supply for hot drinks works can be seen from FIG. 2. The same parts are indicated by the same reference numbers here. The water supply container 3 contains a hot water tank 15 with a catalytic burner 16 which is supplied with gas from a gas cylinder 17 with a control valve 18. The use of the catalytic burner 16 has the advantage that the combustion temperature of the gas, in this case butane gas, is considerably reduced, as a result of which no temperature control is needed. If other fuels are used, a temperature control can be necessary, depending on the combustion temperature. It can be produced in a very simple manner with, for example, a bimetal or the like.

The catalytic burner is ignited by means of an igniter coil which is not shown. The water supply container 3 is insulated with, for example, insulating foam which is provided with a radiation screen (metal foil). Such insulation is capable of keeping the temperature of the outside at approx. 35° C. when the inside, i.e. the tank 15, is at a temperature of approx. 95° C.

A major advantage of a catalytic burner 16 is also that it meets strict safety standards, since no ignition of gases can occur outside the burner, and any risk of explosion is eliminated.

The hot water is conveyed through a pipe 22 to the tap points 10, 11 by means of a motor 20 supplied from a battery 19 and a hot water pump 21 driven by it. The end of tap point 10 is indicated by 10', and is situated in a mixing chamber 23 (to be discussed below) provided with perforations, so that, for example, coffee made therein can flow through the perforations to the tap point 10. Situated past the valves 26, 27 of the tap points 10, 11 is a valve with a temperature gauge 24, which measures the temperature of the water supplied. If said temperature is too low, the water is fed back through the aperture of said valve through a pipe 25 to the hot water tank 15 until the desired temperature is reached. Valve 24 is then closed, and one of the valves 26 and 27 can be opened as desired, so that pipe 22 is connected to the tap point 11 or the mixing chamber 23. The liquid to be tapped will always be at the correct temperature, due to the working of the valves described.

Reference number 28 indicates a control unit with a selector panel, by means of which the user can select a hot drink if desired. The control unit 28 is connected to various gauges, including the gauge in the valve 24. Only a number of gauges will be discussed in the drawing and the description, but other possibilities are also obvious. For example, the water tank 15 contains a gauge 29 which measures the temperature, and depending thereon the control unit regulates the fuel supply or delivers a warning signal, for example by means of a light or the like on the selector panel, with possibly a sound signal. A gauge 30 is also present for measuring the level of the water in the tank 15, and a gauge 31 for measuring the charge condition of the battery. The control unit can deliver warning signals depending on the measured values.

The drawing shows only one supply hopper 32, for adding an extract to the water, for example coffee granules which are added by means of extruder 33 to the hot water in a mixing chamber 23. It will be clear that supply hoppers or containers (for liquid extracts) can also be present, depending on the envisaged use.

At a number of places, for example where the trolley is being used in trains, a filling centre can be present at a number of large stations. The advantage of the trolley according to the invention is that the trolley can very quickly be provided with new filled containers A–D at such a filling centre in the case of exchangeable containers, or the containers can be provided with a new filling in the case of fixed containers. In the former case the layout of the trolley can be varied through variation of the containers, and in the latter case the contents of the trolley can be varied by providing the desired containers with heating means or cooling means. The fixed water supply container can also be filled there.

The heating means of the heat-conserving container and possibly the additional hot water container are preferably designed in the same way as those for the fixed water supply container 3, i.e. a catalytic burner supplied with a fossil fuel. Butane gas is preferable here. This gas can be fitted in, for example, a small tank or the like on the heat-conserving container and connected to the burner. The heating means can also be in the form of separate units to be connected to the containers and each bearing its own fuel source, or they can be connected to a common source. In the case of exchangeable containers it is preferable to fix the heating means on the containers, so that they can be removed as a unit from the frame. In the case of fixed containers mounted in the frame, it is preferable to be able to fit the heating means detachably, for example in an opening in the container. This has the advantage that one or more containers can be provided with heating means very simply and very rapidly. It will be clear that in the case of a cooling container said opening can be shut off with a cap or serve for the fixing of the cooling means. In the case where the container has to act as a supply container, the shut-off cap or the like is inserted into the opening.

It is pointed out that the trolley can also comprise a combination of exchangeable containers and containers fixed in the frame. This can be advantageous, for example through the fact that the additional hot water container can then always be made exchangeable.

Figure 3:
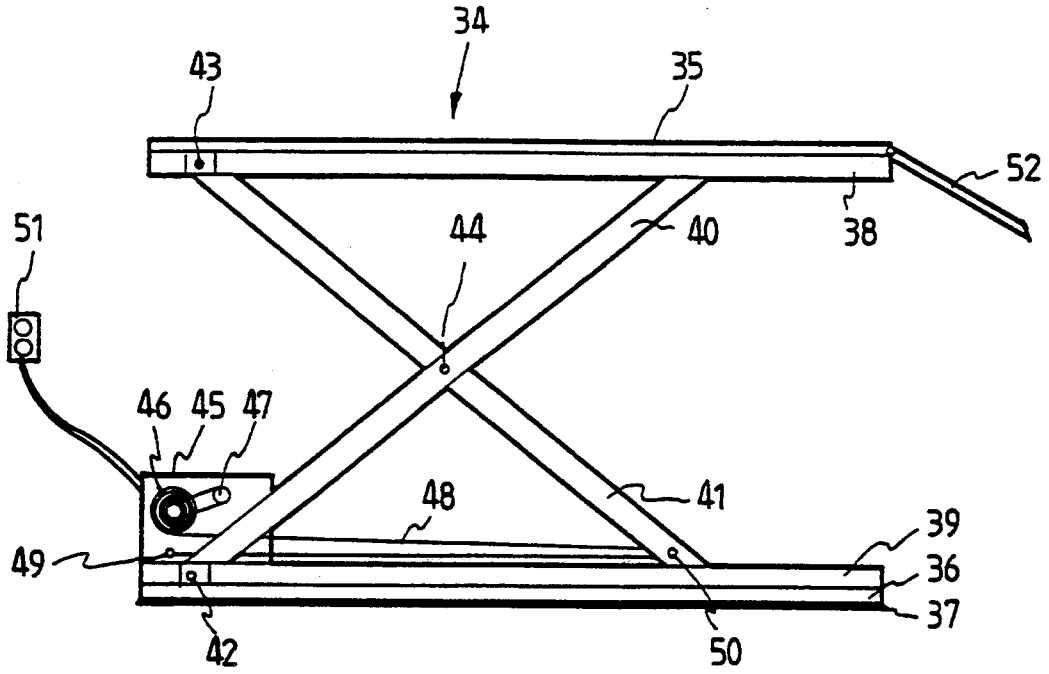
FIG. 3 shows a schematic view of the lifting device according to the invention in side view.

FIG. 3 shows a very schematic representation of a lifting device 34 according to the invention, comprising a carrier plate 35 and a supporting plate 36, the supporting plate 36 being provided with an anti-slip covering 37. Both plates have guide grooves 38, 39 on the inside.

The lifting movement of the device is carried out with a scissor mechanism with arms 40 and 41, the arm 40 being rotatably fixed at 42 on supporting plate 36, and the arm 41 being rotatably fixed at 43 to the carrier plate 35. The other ends of the arms 40 and 41 are slidably mounted in guide grooves 38 and 39. The arms 40 and 41 are hinged to each other at 44. It will be clear that two sets of arms 40, 41 are generally present and can be combined to a rigid assembly.

Situated in a housing 45 is a belt coil 46, which can be driven by a motor 47 supplied by a battery, not shown. Reference number 48 shows a pulling belt which is fastened at one end to a fixing point 49 in the housing 39 and can be wound by means of a guide pin 50 in the arm 41 onto the belt coil 46. The lifting device can be moved up and down by regulating the motor 47 with a regulating element 51. Reference number 52 indicates a run-on plate which is hingedly fixed to the carrier plate 35, so that when the lifting device is in the lowest position the trolley according to the invention can be wheeled onto the lifting device without difficulty. It is, of course, also possible to provide the carrier plate 35 with a similar plate at the side opposite the run-on plate 52, so that the trolley can be wheeled easily from the carrier plate 35 onto the raised place, for example from the lifting device into the train. It is also preferable to provide the carrier plate with grooves, so that the wheels of the trolley are guided therein.

Of course, the up and down movement of the plate 35 with the trolley placed thereon can be altered by using an additional belt, an endless belt with an additional coil, or by using known pulley techniques.

The trolley 1 according to the invention and the lifting device 34 are designed in such a way that the lifting device 34 can easily be suspended in a detachable manner from the trolley 1, preferably at the side lying opposite the handle 6.

Figure 4:
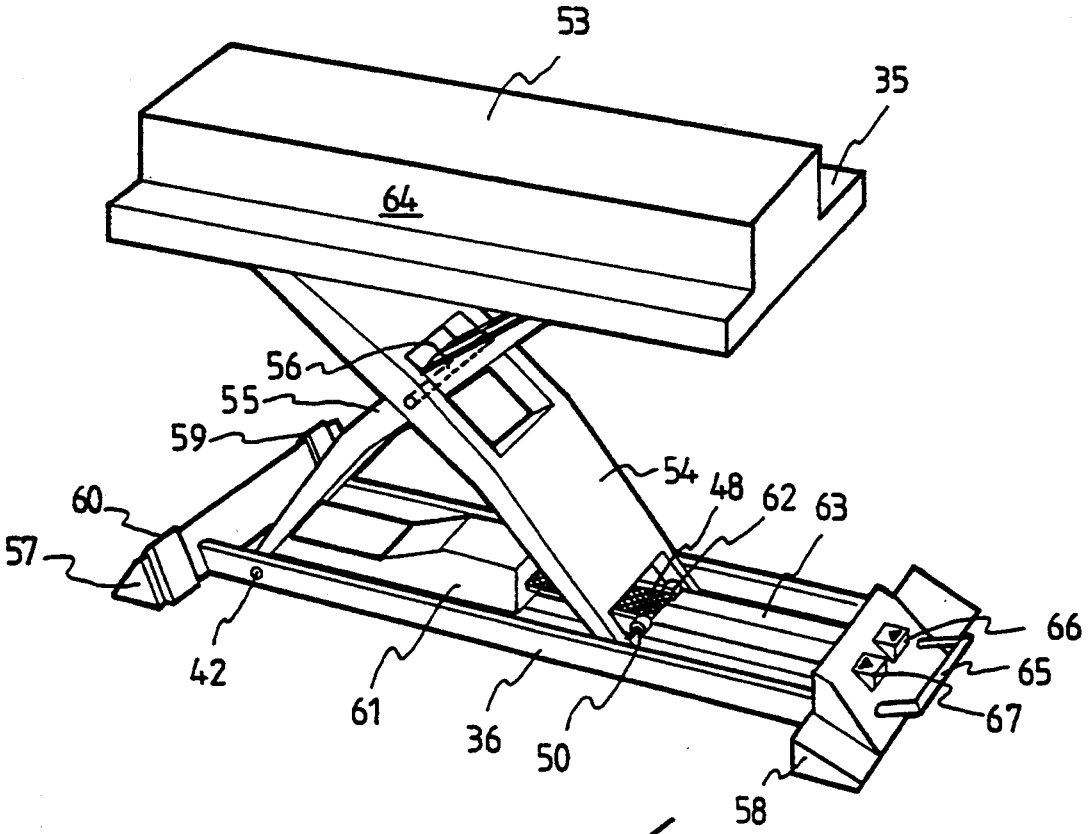
FIG. 4 shows a perspective view of a special embodiment of the lifting device according to the invention.

FIG. 4 shows a special embodiment of the lifting device of FIG. 3. The carrier plate 35 has a longitudinal recess which is provided with a case 53. Said lifting device has two sets of arms 54, 55 which are parallel and are connected to each other locally by a hinge pin 56. The supporting plate 36 is provided with two supports 57, 58 with triangular cross-section. The support 57 has two anti-slip parts 59, 60. The support 58 has an anti-slip covering (not shown) on the underside.

The housing 61 contains the same belt coil with motor as that shown in FIG. 3. The belt 48 is visible in FIG. 4 and runs from belt coil 46 via the guide pin 50 back to the fixing point 49. The guide pin 50 is provided here with two wheels 62, which can roll in guide grooves 63 designed for them. The set of arms 54 is hingedly fixed in the case 53 on the wall 64 and the opposite wall which is not visible. The other end of the set of arms 55 is provided with a shaft with wheels which can move corresponding to wheels 62 and guide grooves 63 in guide grooves in the case 53.

Reference number 65 shows a handle by which the whole lifting device can be conveyed easily in the folded state. Reference numbers 66 and 67 are two foot control switches for regulating the up and down movements of the carrier face 35.

The case 53 is designed in such a way that in the folded state the two sets of arms 54, 55 and the housing 61 can be accommodated therein. This makes the whole device very compact, and no run-on plate is now needed. The support 58 to this end has slanted sides.

At the side of support 57 the carrier plate 35 can easily be extended in order to make it possible for the trolley to be wheeled off the device, for example into a train. For this, a ramp can be laid on the carrier plate 35 and the raised place (for example, the train). This ramp is preferably provided telescopically in the carrier plate 35.

At the underside (not shown) under plate 36 are fixing means which can interact with fixing means on the trolley, so that the lifting device can be easily fixed in a detachable manner thereon.

Through the special shape of the arms, i.e. the curved shape, with the kink under the hinge point 56, the following advantage is obtained. In the folded state of the lifting device the hinge point 56 is situated at a higher level than would be the case with straight arms. The lifting force initially required is considerably reduced as a result.

Figure 5:
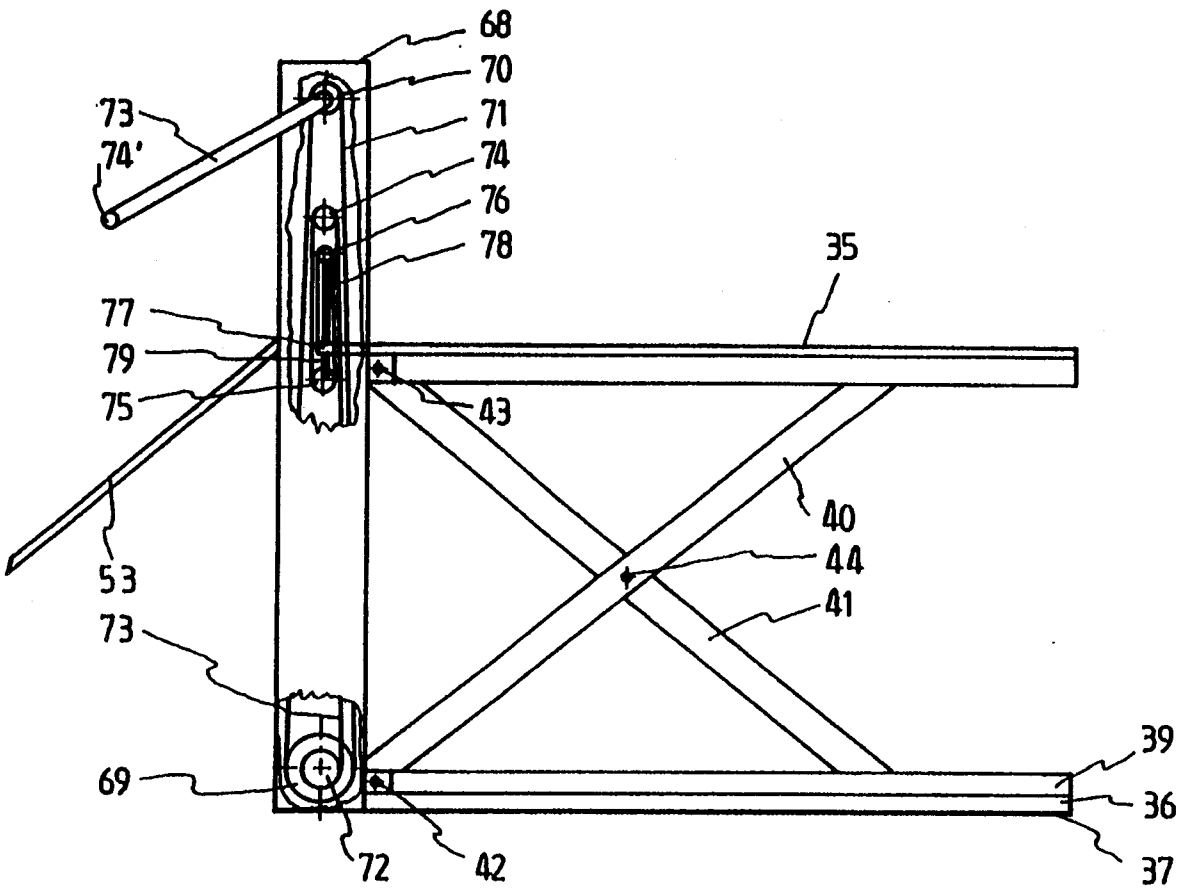
FIG. 5 shows a schematic view of the lifting device according to FIGS. 3 and 4, in a modified embodiment.

FIG. 5 shows a special embodiment of the lifting device according to FIGS. 3 and 4 with a vertical belt drive. Said lifting device in this case comprises columns 68 on both sides thereof, the column shown in the figure being shown cut away and having two toothed-belt pulleys 69 and 70 which can guide a toothed belt 71. The upper toothed-belt pulley 70 in this embodiment can be driven by means of a hand-driven crank 73 with handle 74. The toothed-belt pulley 70 is advantageously of smaller diameter than the toothed-belt pulley 69, in order to obtain a favourable power transmission. Toothed-belt pulley 69 is connected to a belt winding shaft 72, on which the belt 73 can be wound. Said belt 73 runs via guide roller 74, guide roller 75, and then along guide roller 76 to the fixing point 77 to the carrier plate 35. Guide roller 74 is fixed to the column, while the rollers 75 and 76 are fixed, with the interposition of connecting pieces 78 and 79, by the fixing point 77 to the carrier plate 35. Said design of the guide rollers gives the advantage of a suitable power transmission, since the force to be exerted on the crank will be a number of times smaller than the force exerted on the fixing point 77.

It will be clear that suitable braking means are advantageously present, for example a ratchet mechanism, combined with, for example, friction plates, so that during the upward movement of the carrier plate 35 no resistance is encountered, but that, through the weight of the trolley to be lifted with the aid of the lifting device, the device is thereby prevented from folding up if the crank shoots out of the user's hand. The lowering of the lifting device is also thereby simplified.

It is possible to provide the embodiments of the lifting device shown in FIG. 3 or 4 with vertical columns and a crank, in which case the use of the crank mechanism could take over the action of the motor 47. The belt coil 46 could, if desired, be driven directly by means of, for example, a toothed belt or the like, thus making the motor with accompanying battery superfluous.

Toothed belt pulley 69 in FIG. 5 also serves as a hinge, in which case in the lowered state of the lifting device the vertical columns 68 can be flapped down.

It will be clear that, if the dimensions are adapted, the lifting device according to the invention can also be used for lifting larger objects.

We claim:

1. Trolley designed for use as a conveying trolley for conveying products, in particular foods and drinks for sale, comprising a frame provided with wheels and carrying at least one container, characterized in that said frame has means for carrying plural containers one above the other in the frame, the frame in the bottom thereof having a fixed water supply container with insulation and heating means, and a pump with battery supply for conveying the water heated in said fixed water supply container to at least one tap point, supply means connected to at least one tap point for adding an extract to water heated in said fixed water supply container, and wherein said at least one container carried in said frame is selected from the group consisting of:

(i) an insulated heat-conserving container with heating means;

(ii) an insulated cooling container;

(iii) an insulated hot water container which is to be coupled to the fixed water supply container; and (iv) a supply container;

(v) an insulated hot water container which is to be coupled to the fixed water supply container and which is provided with heating means; and (vi) a supply container which is insulated.

2. Trolley according to claim 1, characterized in that said at least one container carried in said frame comprises heating means and wherein said heating means are exchangeable from said at least one container to another.

3. Trolley according to claim 1, characterized in that said at least one container carried in said frame comprises cooling means and wherein said cooling means are exchangeable from said at least one container to another.

4. Trolley according to claim 1, characterized in that said at least one container carried in said frame is exchangeable with another container add wherein the other container is selected from the same group as the said at least one container carried in the frame.

5. Trolley according to claim 2, further comprising cooling means and further characterized in that the heating means and the cooling means are interchangeable.

6. Trolley according to claim 1, wherein said at least one container carried in said frame comprises heating means and further characterized in that the heating means are in the form of a catalytic burner, and further comprising at least one supply container for a fossil fuel.

7. Trolley according to claim 6, characterized in that said at least one supply container contains a fossil fuel and wherein said fossil fuel is butane gas.

8. Trolley according to claim 1, characterized in that a temperature gauge and a return pipe having at least one valve are provided near each tap point so that when a predetermined difference between a set temperature and a temperature measured by said temperature gauge is gauged, a valve in the return pipe is opened to return the water to the supply container until the temperature gauge determines that the set temperature has been reached.

9. Trolley according to claim 1, further comprising gauges for measuring the temperature and the level of water in the supply container, monitoring whether or not the heating means are working, and measuring the charge condition of the battery supply of the pump and wherein the gauges are connected to a control unit which can deliver advisory signals depending on the values measured by the gauges.

* * * * *